US007596340B2

(12) United States Patent
Obuchi et al.

(10) Patent No.: US 7,596,340 B2
(45) Date of Patent: Sep. 29, 2009

(54) IMAGE FORMING APPARATUS HAVING DEVELOPER CONTAINING PORTION WITH SLENDER END PORTION

(75) Inventors: Kenji Obuchi, Saitama (JP); Keiji Sasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/943,942

(22) Filed: Nov. 21, 2007

(65) Prior Publication Data

US 2008/0175624 A1 Jul. 24, 2008

Related U.S. Application Data

(63) Continuation of application No. 10/947,151, filed on Sep. 23, 2004, now Pat. No. 7,317,888.

(30) Foreign Application Priority Data

Feb. 16, 2004 (JP) ..... 2004-038842

(51) Int. Cl.
*G03G 15/08* (2006.01)
*G03G 15/01* (2006.01)

(52) U.S. Cl. ..... 399/120; 399/227

(58) Field of Classification Search ..... 399/120, 399/358, 359, 360, 227
See application file for complete search history.

(56) References Cited

U.S. PATENT DOCUMENTS 4,615,612 A 10/1986 Ohno et al.
4,622,916 A 11/1986 Tanaka et al.
4,963,940 A * 10/1990 Nemoto et al. ..... 399/360
5,325,151 A 6/1994 Kimura et al.
5,598,254 A * 1/1997 Ikesue et al. ..... 399/358
6,415,118 B1 7/2002 Setoriyama et al.
6,711,374 B2 * 3/2004 Funayama et al. ..... 399/359
6,999,705 B2 * 2/2006 Yoshino et al. ..... 399/120
7,035,574 B2 * 4/2006 Deguchi et al. ..... 399/120
7,039,345 B2 * 5/2006 Miller
2003/0147671 A1 8/2003 Kishigami
2004/0062571 A1 4/2004 Moritani
2004/0114962 A1 6/2004 Okamoto et al.

(Continued)

FOREIGN PATENT DOCUMENTS

JP 8-254874 A 10/1996

(Continued)

*Primary Examiner*—Susan S Lee
(74) *Attorney, Agent, or Firm*—Sughrue Mion, PLLC

(57) ABSTRACT

A developer cartridge for supplying a toner-containing developer, including a developer containing portion; a developer recovery portion, disposed at one end of the developer containing portion in a longitudinal direction; a supply port that supplies the developer from the developer containing portion to the developing unit; a recovery port through which used developer supplied from the developing unit passes to the developer recovery portion; and an opening and closing member, coupled to the outer circumferential of the developer containing portion and the developer recovery portion, that opens or closes the supply port and the recovery port. The developer containing portion has first and second end portions, the first end portion being more slender than the second end portion and linked to the developer recovery portion, wherein a tapered portion is provided between the first end portion and the second end portion.

5 Claims, 14 Drawing Sheets

U.S. PATENT DOCUMENTS

2004/0165912 A1 8/2004 Tanaka
2004/0184837 A1 9/2004 Kinouchi

FOREIGN PATENT DOCUMENTS

JP 11-249419 A 9/1999
JP 2001-100473 A 4/2001
JP 2001-175077 A 6/2001
JP 2001-281950 A 10/2001
JP 2002-341706 A 11/2002

* cited by examiner

IMAGE FORMING APPARATUS HAVING DEVELOPER CONTAINING PORTION WITH SLENDER END PORTION

This is a continuation of application Ser. No. 10/947,151 filed Sep. 23, 2004, which claims priority from JP Application No. 2004-038842 filed Feb. 16, 2004, the entire disclosure of each of which is incorporated herein by reference.

BACKGROUND OF THE INVENTION

1. Field of the Invention

The present invention relates to a developing cartridge capable of opening or closing a supply port and a recovery port at the same time.

2. Description of the Related Art

Conventionally, the image forming apparatuses of electrophotography such as a full-color copying machine, a printer, a facsimile apparatus and a composite apparatus thereof are based on a so-called tandem system is well known in which a plurality of image forming portions corresponding to each color of yellow, magenta, cyan and black are arranged in parallel, a toner image of each color of yellow, magenta, cyan and black formed by each image forming portion is directly transferred onto the recording sheet, or secondarily transferred via an intermediate transfer belt onto the recording sheet to form a full-color image.

Also, some image forming apparatuses such as the full-color copying machine, printer and so on are based on a so-called four cycle system in which a plurality of developing units corresponding to each color of yellow, magenta, cyan and black are arranged adjacent to a single photoconductive drum along the circumferential direction of a developing device main body, the developing device main body is rotationally driven to move a developing unit of each color to a developing position opposed to the photoconductive drum, a toner image of each color of yellow, magenta, cyan and black is formed on the photoconductive drum by rotating the photoconductive drum a predetermined number of times, and the toner image of each color of yellow, magenta, cyan and black formed on the photoconductive drum is directly transferred onto the recording sheet, or secondarily transferred via the intermediate transfer belt onto the recording sheet.

SUMMARY OF THE INVENTION

An object of the invention is to provide a developing cartridge capable of opening or closing a supply port and a recovery port at the same time.

In order to accomplish the above object, according to a first aspect of the invention, there is provided an image forming apparatus comprising a rotary developing device having a developing device main body rotatably disposed and a plurality of developing units arranged along a rotation direction of the developing device main body, a frame for supporting the rotary developing device in free rotation, and a drive source for rotationally driving the rotary developing device, wherein the drive source for rotationally driving the rotary developing device is disposed in an area to which the rotary developing device is projected in a direction orthogonal to a rotation axis.

Also, according to a second aspect of the invention, there is provided the image forming apparatus according to the first aspect wherein a driving force of the drive source is transmitted to a driving gear with external teeth disposed around the outer circumference at one end portion of the rotary developing device.

Also, according to a third aspect of the invention of the third aspect, there is provided the image forming apparatus according to the first or second aspect wherein the drive source is mounted on the same plane of the frame as the rotary developing device.

Also, according to a fourth aspect of the invention, there is provided the image forming apparatus according to any one of the first to third aspects, wherein the drive source and the rotary developing device are mutually connected via a reduction gear.

Further, according to a fifth aspect of the invention, there is provided an image forming apparatus comprising an image carrier disposed rotatably, a rotary developing device for developing sequentially an electrostatic latent image formed on the image carrier with a toner of different color, in which a developing device main body is rotatably disposed and a plurality of developing units are arranged along a rotation direction of the developing device main body, an intermediate transfer body on which a primary transfer of a toner image of different color developed sequentially on the image carrier is performed multiply, and secondary transfer means for performing a secondary transfer of the toner image of different color transferred onto the intermediate transfer body multiply onto a recording sheet, wherein the intermediate transfer body is overlapped on top of the rotary developing device, a primary transfer position and a secondary transfer position of the intermediate transfer body are closely placed, and the drive source for rotationally driving the rotary developing device is disposed at a position opposed at about 180° to the image carrier around the outer circumference of the rotary developing device in an area to which the rotary developing device is projected in a direction orthogonal to a rotation axis.

Also, according to a sixth aspect of the invention, there is provided the image forming apparatus according to the fifth aspect, wherein a control board of the image forming apparatus is disposed in the area to which the rotary developing device is projected in the direction orthogonal to the rotation axis.

Moreover, according to a seventh aspect of the invention, there is provided the image forming apparatus according to the fifth aspect, wherein a power source unit of the image forming apparatus is disposed in the area to which the rotary developing device is projected in the direction orthogonal to the rotation axis.

This invention provides the image forming apparatus of small size, which can be made as thin as possible in the direction of rotational axis of the rotary developing device.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

The preferred embodiments of the present invention will be described below with reference to the accompanying drawings.

First Embodiment

Figure 2:
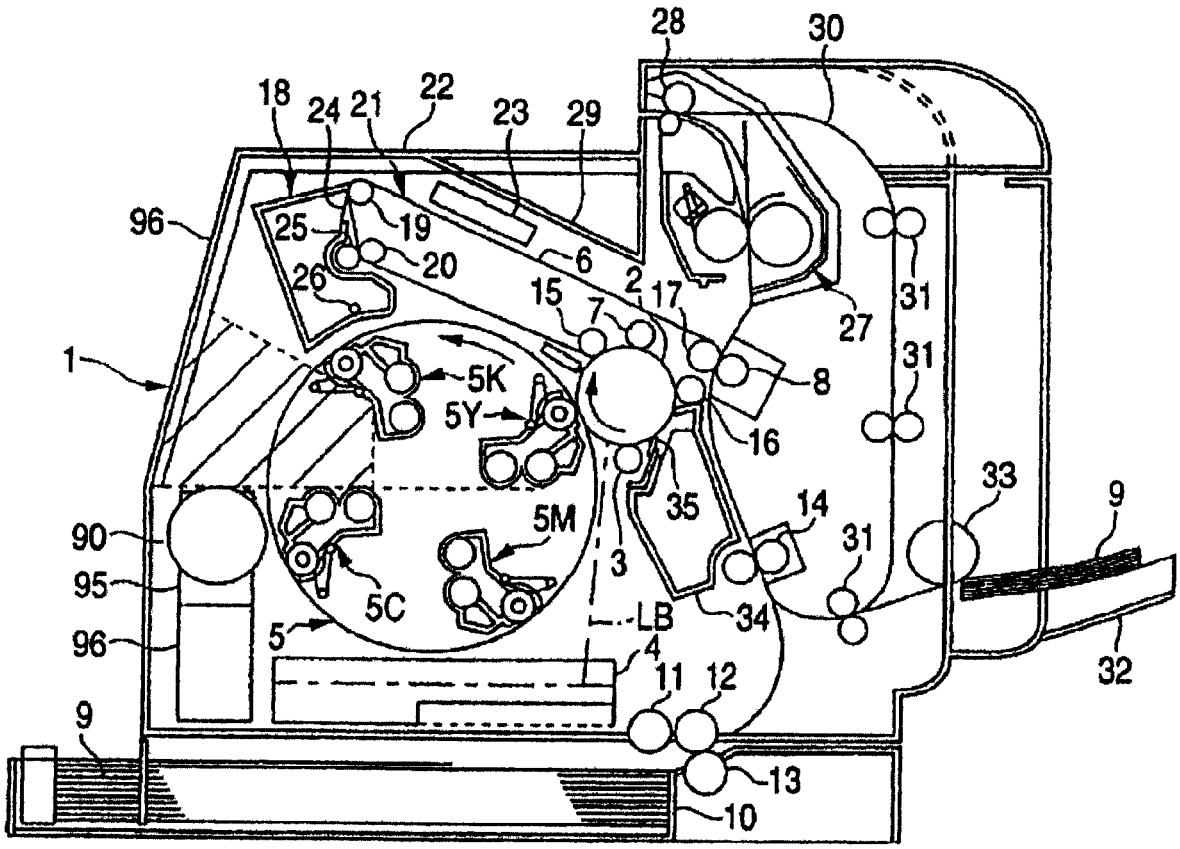
FIG. 2 is a schematic view showing the full-color printer as the image forming apparatus according to the first embodiment of this invention.

FIG. 2 shows a full-color printer of four cycle system as an image forming apparatus according to a first embodiment of the invention.

In FIG. 2, reference numeral denotes a full-color printer main body. A photoconductive drum 2 as an image carrier is disposed rotatably at a slightly right upper part of the center inside the full-color printer main body 1. This photoconductive drum 2 is a conductive cylinder having a diameter of about 47 mm with a photoconductive layer made of OPC covered on the surface, for example, and driven rotationally at a process speed of about 150 mm/sec along the arrow direction by driving means, not shown. After the surface of the photoconductive drum 2 is charged at a predetermined potential by a charging roll 3 as charging means that is disposed almost directly under the photoconductive drum 2, the image is exposed to a laser beam (LB) by an ROS4 (Raster Output Scanner) as exposure means that is disposed at a separated position directly under the photoconductive drum 2, so that an electrostatic latent image is formed according to image information. The electrostatic latent image formed on the photoconductive drum 2 is developed by a rotary developing device including the developing units 5Y, 5M, 5C and 5K corresponding to each color of yellow (Y), magenta (M), cyan (C) and black (K) that are disposed along the circumferential direction to form a toner image of each color.

On the surface of the photoconductive drum 2, each process of charging, exposure and developing is repeated by a predetermined number of times corresponding to the color of the image to be formed. In the rotary developing device 5, the developing unit 5Y, 5M, 5C or 5K of corresponding color is moved to a developing position opposed to the photoconductive drum 2. For example, when the full-color image is formed, each process of charging, exposure and developing is repeated four times on the surface of the photoconductive drum 2, corresponding to each color of yellow (Y), magenta (M), cyan (C) and black (K), so that a toner image corresponding to each color of yellow (Y), magenta (M), cyan (C) and black (K) is sequentially formed on the surface of the photoconductive drum 2. When the toner image is formed, the number of rotating the photoconductive drum 2 is different depending on the size of image. For example, for the A4 size, when the photoconductive drum 2 is rotated three times, one image is formed. That is, the toner image corresponding to each color of yellow (Y), magenta (M), cyan (C) and black (K) is sequentially formed on the surface of the photoconductive drum 2, every time the photoconductive drum 2 is rotated three times.

The toner image corresponding to each color of yellow (Y), magenta (M), cyan (C) and black (K) sequentially formed on the surface of the photoconductive drum 2 is primarily transferred by a primary transfer roll 7 at a primary transfer position where an intermediate transfer belt 6 as an intermediate transfer body is wound around the outer circumference of the photoconductive drum 2, and superimposed mutually on the intermediate transfer belt 6. The toner image of each color of yellow (Y), magenta (M), cyan (C) and black (K) multiply transferred onto the intermediate transfer belt 6 is secondarily transferred collectively onto the recording sheet 9 supplied at a predetermined timing by a secondary transfer roll 8. The recording sheet 9 is picked up by a pick-up roll 11 from a paper supply cassette 10 disposed on the bottom of the full-color printer main body 1. One sheet is fed out by a feed roll 12 and a retard roll 13, and conveyed to a secondary transfer position of the intermediate transfer belt 6 by a resist roll 14 to be synchronous with the toner image transferred onto the intermediate transfer belt 6.

The intermediate transfer belt 6 is stretched around a plurality of rolls, and driven to be circularly moved at a predetermined process speed (about 150 mm/sec), along with the rotation of the photoconductive drum 2. This intermediate transfer belt 6 is stretched under a preset tension by means of a lap-in roll 15 for designating the lap position of the intermediate transfer belt 6 on the upstream side of the photoconductive drum 2 in the rotational direction, a primary transfer roll 7 for transferring the toner image formed on the photoconductive drum 2 onto the intermediate transfer belt 6, a lap-out roll 16 for designating the lap position of the intermediate transfer belt 6 on the downstream side of the lap position, a back-up roll 17 contacting with the secondary transfer roll 8 via the intermediate transfer belt 6, a first cleaning back-up roll 19 opposed to a cleaning device 18 of the intermediate transfer belt 6, and a second cleaning back-up roll 20.

Also, the intermediate transfer belt 6 is stretched by a plurality of rolls 7, 15 to 17, 19 and 20, as described above. In this embodiment, the intermediate transfer belt 6 is stretched in the shape of a flat, slender, and almost trapezoid in cross section to reduce the size of the full-color printer main body 1.

By the way, in this embodiment, the image forming apparatus comprising the rotary developing device in which the developing device main body is disposed rotatably within the vertical plane, and the plurality of developing units and developer cartridges for supplying developer to the developing units are disposed along the circumferential direction of the developing device main body, and a replacement cover for allowing the developer cartridge of the rotary developing device to be replaced, a lever member being rotated along with an opening or closing operation of the replacement cover to regulate the rotational operation by interfering with a part of the developer cartridge not mounted at a proper mounting position of the developing device main body, and an abutment member, provided on the replacement cover, for making contact with the lever member for regulating the rotational operation to keep the replacement cover from being closed, when the developer cartridge is not mounted at a proper mounting position of the developing device main body.

That is, in this embodiment, the rotary developing device 5 occupies a large space in the full-color printer main body 1, although the total size of the full-color printer is made as small as possible, as shown in FIG. 2. Therefore, the full-color printer main body 1 is designed to make the size of the apparatus smaller and improve the maintenance of the intermediate transfer belt 6 and the rotary developing device 5. More specifically, the intermediate transfer belt 6 makes up an image forming unit 21 together with the photoconductive drum 2 and the charging roll 3, and the image forming unit 21 as a whole is attached or detached on or from the full-color printer main body 1 by opening an upper cover 22 of the full-color printer main body 1. A position sensor 23 including a reflection type photo-sensor for sensing a patch of toner formed on the intermediate transfer belt 6 is disposed on an upper part of the intermediate transfer belt 6.

Also, the cleaning device 18 of the intermediate transfer belt 6 comprises a scraper 24 disposed in contact with the surface of the intermediate transfer belt 6 stretched by the first cleaning back-up roll 19, and a cleaning brush 25 disposed in pressure contact with the surface of the intermediate transfer belt 6 stretched by the second cleaning back-up roll 20, as shown in FIG. 2. The residual toner or paper powder removed by the scraper 24 and the cleaning brush 25 is withdrawn into the inside of the cleaning device 18. The cleaning device 18, which is swingable in a counterclockwise direction in the figure around a swing axis 26, takes refuge to a position away from the surface of the intermediate transfer belt 6, till the secondary transfer of the toner image of last color is ended, and makes contact with the surface of the intermediate transfer belt 6, if the secondary transfer of the toner image of last color is ended.

Moreover, the recording sheet 9 onto which the toner image is transferred from the intermediate transfer belt 6 is conveyed to a fixing unit 27, as shown in FIG. 2. In the fixing unit 27, the toner image is fixed on the recording sheet 9 by heat and pressure. When printed on one side, the recording sheet 9 is directly exhausted onto a paper exhaust tray 29 provided on an upper part of the printer main body 1 by a paper exhaust roll 28.

On the other hand, when printed on both sides, the recording sheet 9, on which the toner image is fixed by the fixing unit 27, is not directly exhausted on the paper exhaust tray 29 by the paper exhaust roll 28, but the paper exhaust roll 28 is rotated reversely in a state where a trailing end part of the recording sheet 9 is carried by the paper exhaust roll 28, and the conveyance passage of the recording sheet 9 is switched to a perfect printing paper conveyance passage 30, whereby the recording sheet 9 is turned over by a conveying roll 31 disposed on the perfect printing paper conveyance passage 30 and conveyed to the secondary transfer position of the intermediate transfer belt 6 again to form the image on the back side of the recording sheet 9.

Moreover, the full-color printer is able to mount an optional manual insertion tray 32 on the side face of the printer main body 1 in freely opening or closing manner, as shown in FIG. 2. The recording sheet 9 of any size and kind laid on this manual tray 32 is fed by a paper feed roll 33, and conveyed via a conveying roll 31 and the resist roll 14 to the secondary transfer position of the intermediate transfer belt 6, where the image is formed on the recording sheet 9 of any size and kind.

From the surface of the photoconductive drum 2 after the transfer process of the toner image is ended, the residual toner is removed by a cleaning blade 35 of a cleaning device 34 disposed obliquely under the photoconductive drum 2 at every rotation of the photoconductive drum 2, thereby preparing for the next image forming process.

Figure 3:
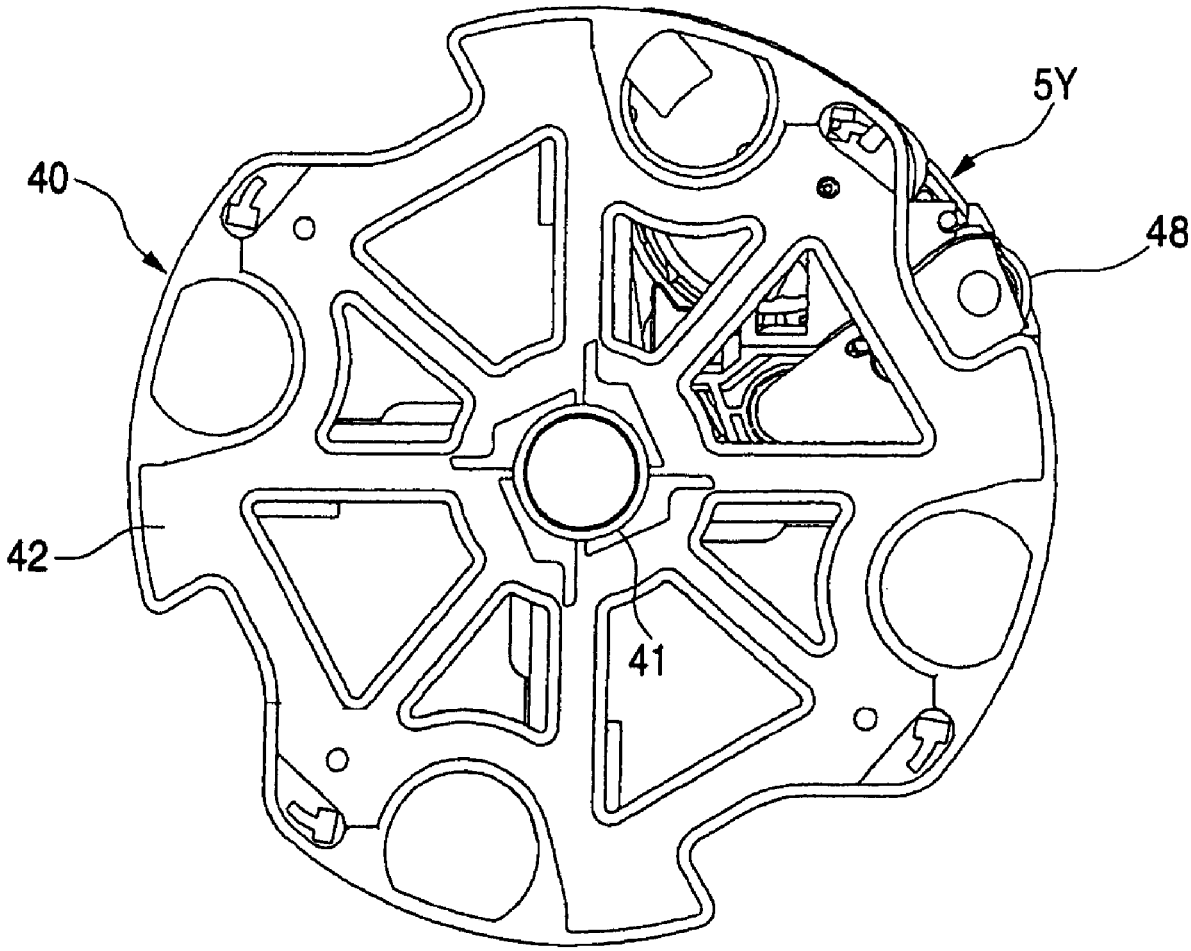
FIG. 3 is a front view showing a rotary developing device.

FIG. 3 is an appearance perspective view showing one specific example of the rotary developing device 5 which is applied to the image forming apparatus according to this embodiment. For convenience's sake, one developing unit 5Y and one developer cartridge 45Y mounted on the developing device main body are shown in FIG. 3.

Figure 4:
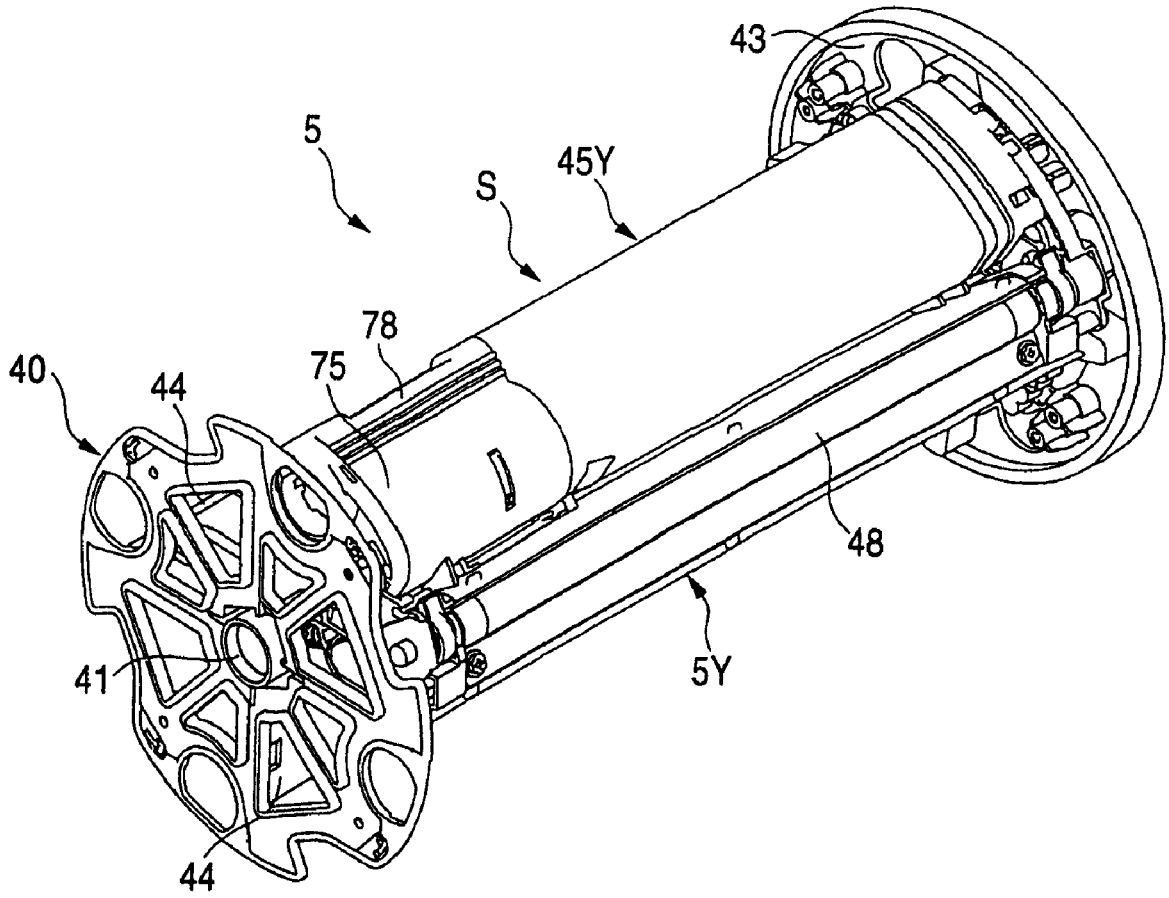
FIG. 4 is a perspective view showing the rotary developing device.

This rotary developing device 5 comprises a developing device main body 40 disposed rotatably within the vertical plane, as shown in FIGS. 3 and 4. The developing device main body 40 comprises a cylindrical rotation shaft member 41 disposed in the central part along the longitudinal direction, a front flange member 42 disposed at a fore end in the longitudinal direction of the rotation shaft member 41, a rear flange member 43 disposed at a rear end in the longitudinal direction of the rotation shaft member 41, and a partition member 44 for partitioning a cylindrical space S formed by the rotation shaft member 41 and the front and rear flange members 42 and 43 into four at 90 degrees.

Figure 5:
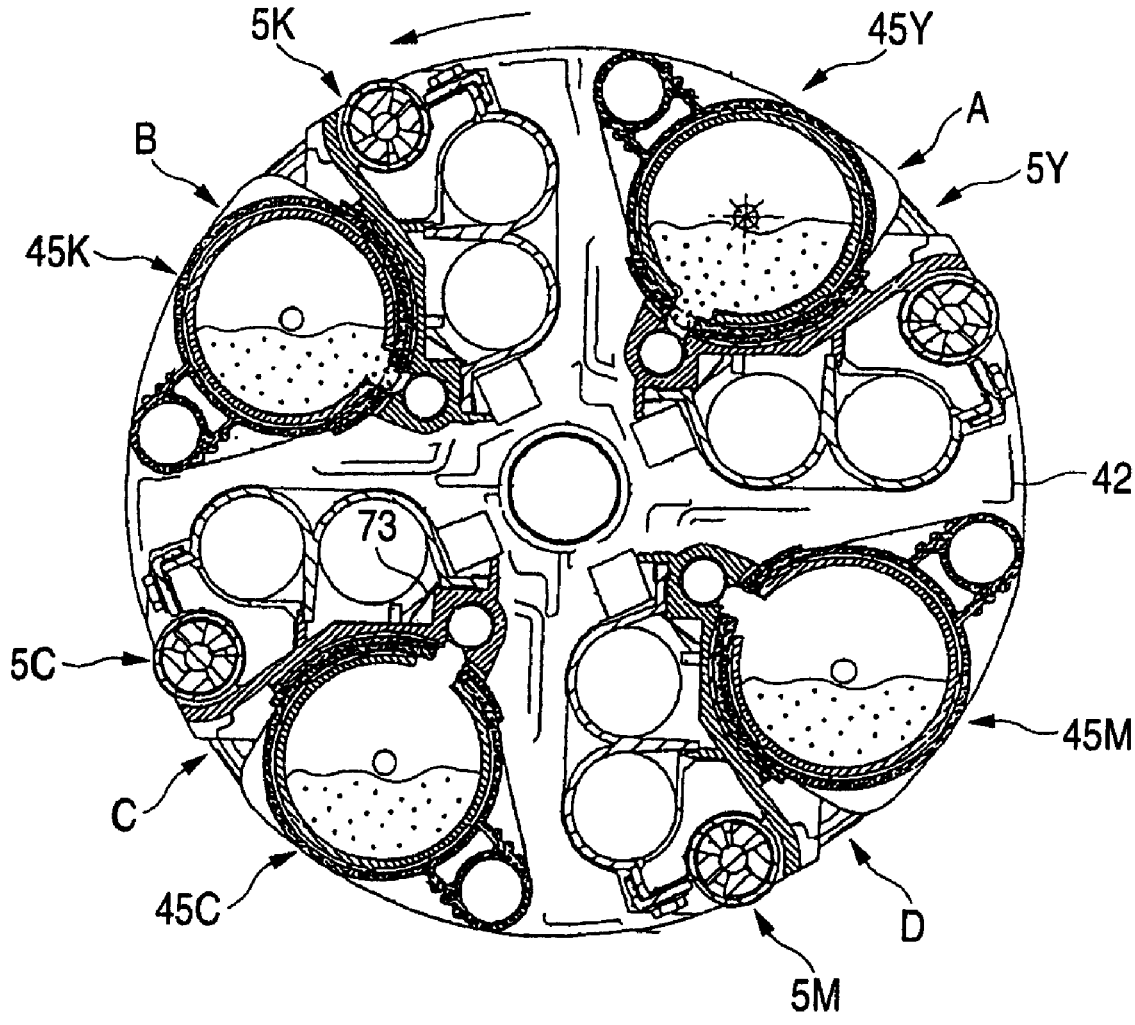
FIG. 5 is a cross-sectional view showing the rotary developing device.

The developing device main body 40 is mounted on the printer main body 1 to be rotatable along the counterclockwise direction around the rotation shaft member 41, as shown in FIG. 2. This developing device main body 40 has four developing units 5Y, 5M, 5C and 5K of yellow (Y), magenta (M), cyan (C) and black (K), arranged clockwise, which are packaged along the circumferential direction, and four developer cartridges 45Y, 45M, 45C and 45K of yellow (Y), magenta (M), cyan (C) and black (K) corresponding to the developing units 5Y, 5M, 5C and 5K, which are packaged along the circumferential direction, as shown in FIG. 5.

Since these developing units 5Y, 5M, 5C and 5K are constituted in the same way, a yellow (Y) developing unit 5Y will be described below. This yellow (Y) developing unit 5Y has a developing unit main body 46, which is supplied with new developer from the corresponding developer cartridge 45Y, as shown in FIG. 5.

Figure 6A:
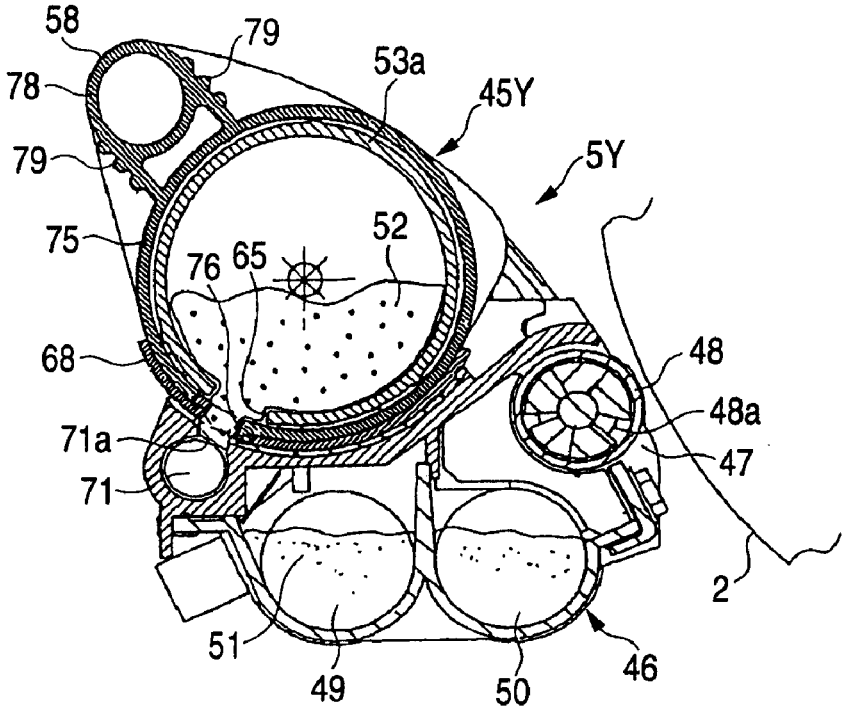
FIGS. 6A and 6B are cross-sectional views showing a developing unit.
Figure 6B:
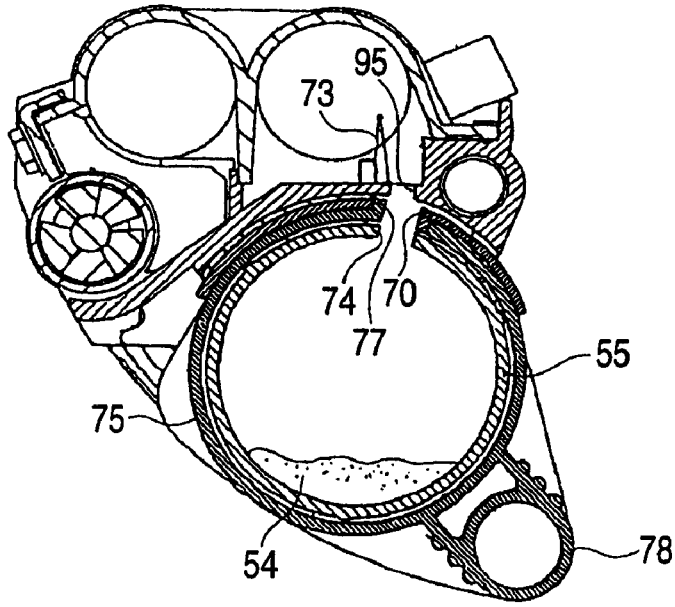
Figure 7:
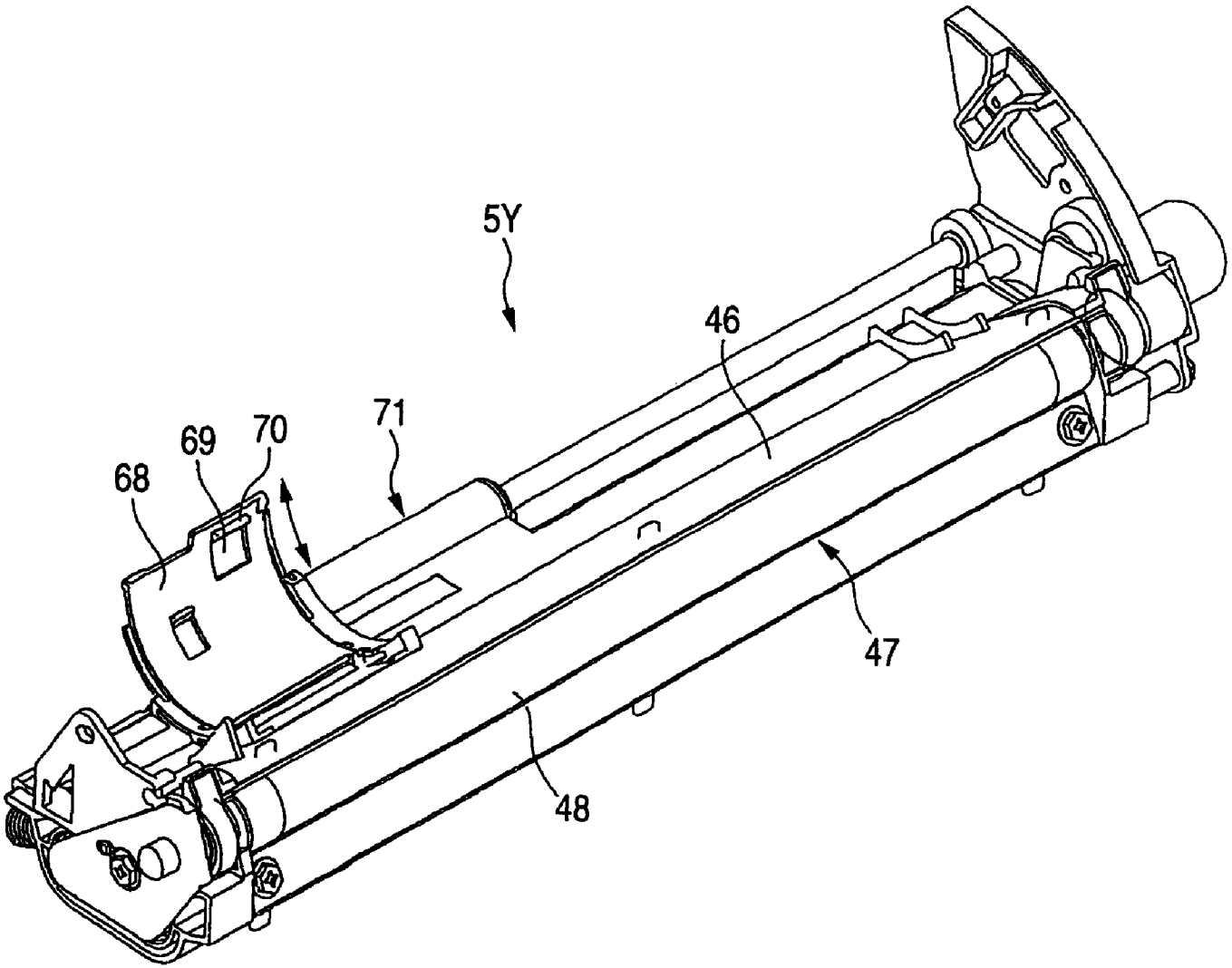
FIG. 7 is a perspective view showing the developing unit.

Inside the developing unit main body 46, there are disposed a developing roll 48 long in a direction perpendicular to the paper face, a part thereof being exposed to an opening portion 47 provided facing around the outer circumference of the developing unit main body 46, and two spiral augers 49, 50 located on the rear side obliquely under the developing roll 48, and extending in parallel to the developing roll 48, as shown in FIG. 6A. The developing roll 48 is disposed substantially over the total length of the developing unit main body 46, as shown in FIG. 7. In the developing unit 5Y, if the developing roll 48 is rotated, a spiral auger 49 on the deeper side conveys the developer 51 received within the developing unit main body 46 in one direction perpendicular to the paper face, while agitating it, as shown in FIGS. 6A and 6B. On the other hand, a spiral auger 50 conveys the developer 51 in a direction opposite to the conveying direction of the spiral auger 49, while agitating it, thereby supplying the developer 51 to the developing roll 48 uniformly. The developer 51 supplied on the surface of the developing roll 48 is regulated in layer thickness by a layer thickness regulating member 52, and conveyed to a developing area opposed to the photoconductive drum 2, along with the rotation of the developing roll 48. In this embodiment, the developer 51 uses a two component developer containing the toner and carrier, but the developer 51 may use one component developer containing the toner alone, because it is only necessary to contain the toner.

The developing roll 48 adsorbs the carrier contained in the developer 51 due to a magnetic force by a magnet roll 48*a* disposed inside in fixed state, forms a magnetic brush of the developer 51 on the surface of the developing roll 48, and conveys the toner adsorbed into the carrier to the developing area opposed to the photoconductive drum 2, as shown in FIGS. 6A and 6B. And the electrostatic latent image formed on the photoconductive drum 2 is visualized by the magnetic brush of the developer 51 containing the carrier and toner that is formed on the surface of the developing roll 48.

Also, the developer cartridges according to this embodiment are provided corresponding to the plurality of developing units disposed along the circumferential direction of the developing device main body, which is disposed rotatably within the vertical plane, each developer cartridge supplying the developer at least containing the toner to the corresponding developing unit. The developer cartridge comprises a developer receiving portion for receiving the new developer, and a developer withdrawal portion, extending to one end of the developer receiving portion in the longitudinal direction, for withdrawing the used developer from the developing unit, in which the cross-sectional shape of the developer receiving portion is formed like non-circle to occupy almost all the space except for the developing unit among the space allocated to one developing unit of the developing device main body on which the developer cartridge is mounted, and the cross-sectional shape of the developer withdrawal portion is formed like circle to be substantially inscribed in the space except for the developing unit among the space allocated to one developing unit of the developing device main body on which the developer cartridge is mounted.

Also, in this embodiment, the cross-sectional shape of the developer receiving portion has two side faces making an acute angle to each other.

Moreover, in this embodiment, the cross-sectional shape of the developer receiving portion is formed roughly like teardrop.

Also, in this embodiment, a supply port opened to the developer withdrawal portion in communication to the developer receiving portion, an opening/closing member for opening or closing the supply port, and a grip for gripping the developer cartridge that is mounted or dismounted on or from the developing device main body, the grip being formed integrally with the opening/closing member.

Moreover, in this embodiment, the opening/closing member is formed cylindrically to be inserted and fitted rotatably around the outer circumference of the developer receiving portion, the grip being protruded radially outwards in a part of the outer circumferential face of the opening/closing member.

Also, in this embodiment, the grip is received within the outer circumferential face of rotation of the developing device main body in a state where the developing device main body is rotatable.

Moreover, in this embodiment, a grip portion of the grip may be provided with non-slip means.

Also, in this embodiment, the developer cartridge may be provided with a lock mechanism for preventing the opening/closing member from being rotated in a direction to open the supply port in a state where the developer cartridge is removed from the developing device main body.

Moreover, in this embodiment, the developer cartridge may be provided with a stopper mechanism for preventing the developer cartridge from being removed from the developing device main body in a state where the opening/closing member opens the supply port.

Also, in this embodiment, the grip may be protruded out of the outer circumferential face of rotation of the developing device main body in a state where the developer cartridge is removable from the developing device main body.

Figure 8:
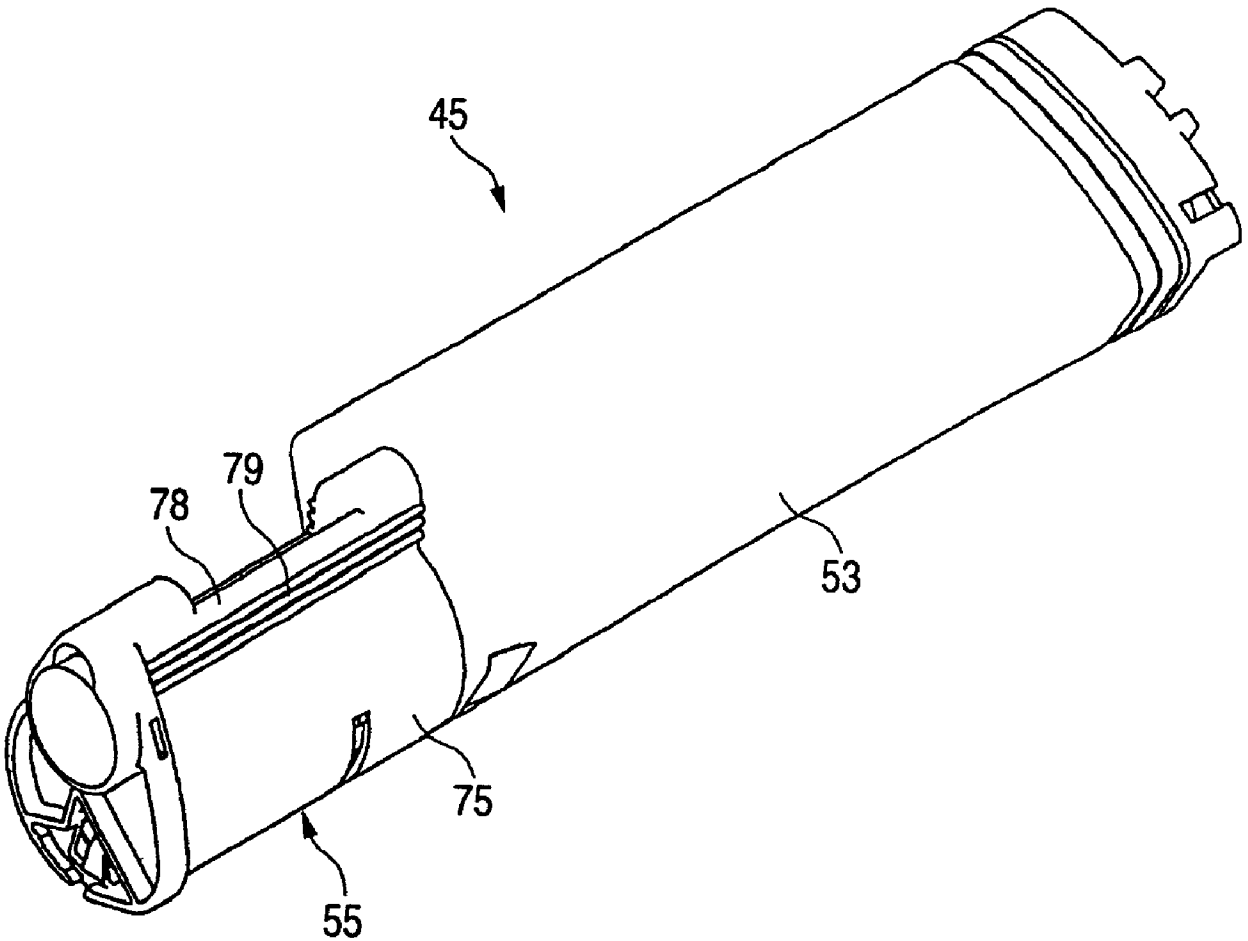
FIG. 8 is a perspective view showing a developer cartridge.

That is, the developer cartridge 45 is a long and cylindrical container having a non-circular shape mostly in cross section, as shown in FIG. 3 and FIGS. 8 and 9. The inside of this developer cartridge 45 is divided into a developer receiving portion 53 for receiving the new developer 52 and a developer withdrawal portion 55 for withdrawing the used developer 54 by a partition cap 56, as shown in FIG. 10. In the illustrated embodiment, the developer receiving portion 53 occupies about four-fifths the total length of the developer cartridge 45, and the developer withdrawal portion 55 occupies about one-fifth. However, the proportion of the length of the developer receiving portion 53 to the length of the developer withdrawal portion 55 may be different.

Figure 9A:
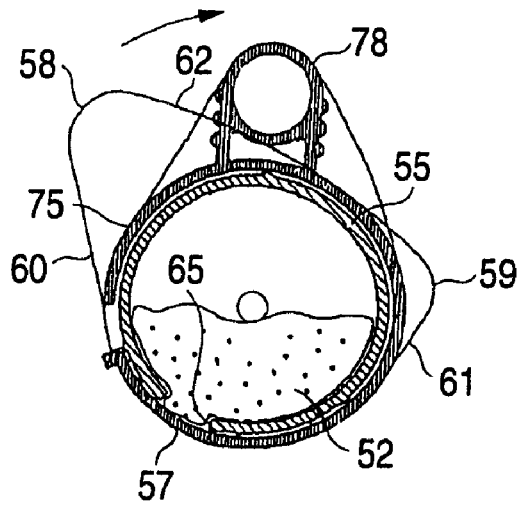
FIGS. 9A to 9C are transverse cross-sectional views showing the developer cartridge.
Figure 9B:
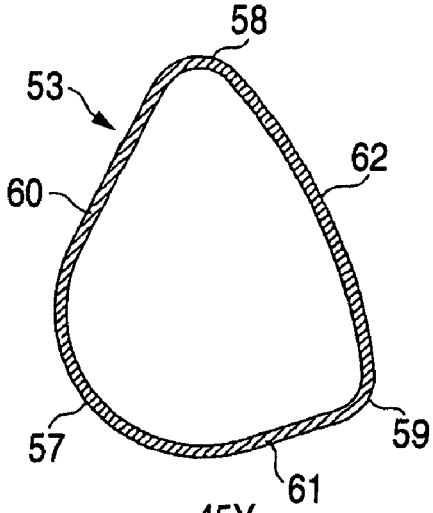
Figure 9C:
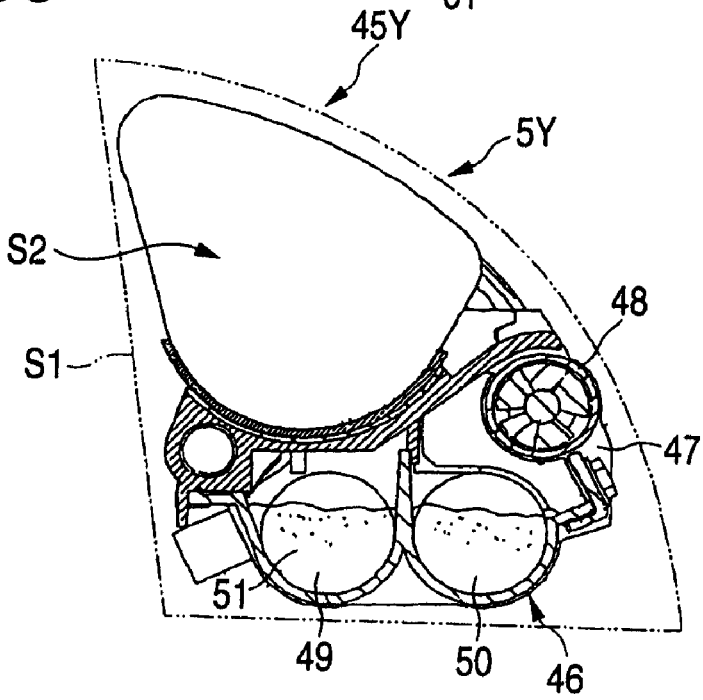
Figure 10:
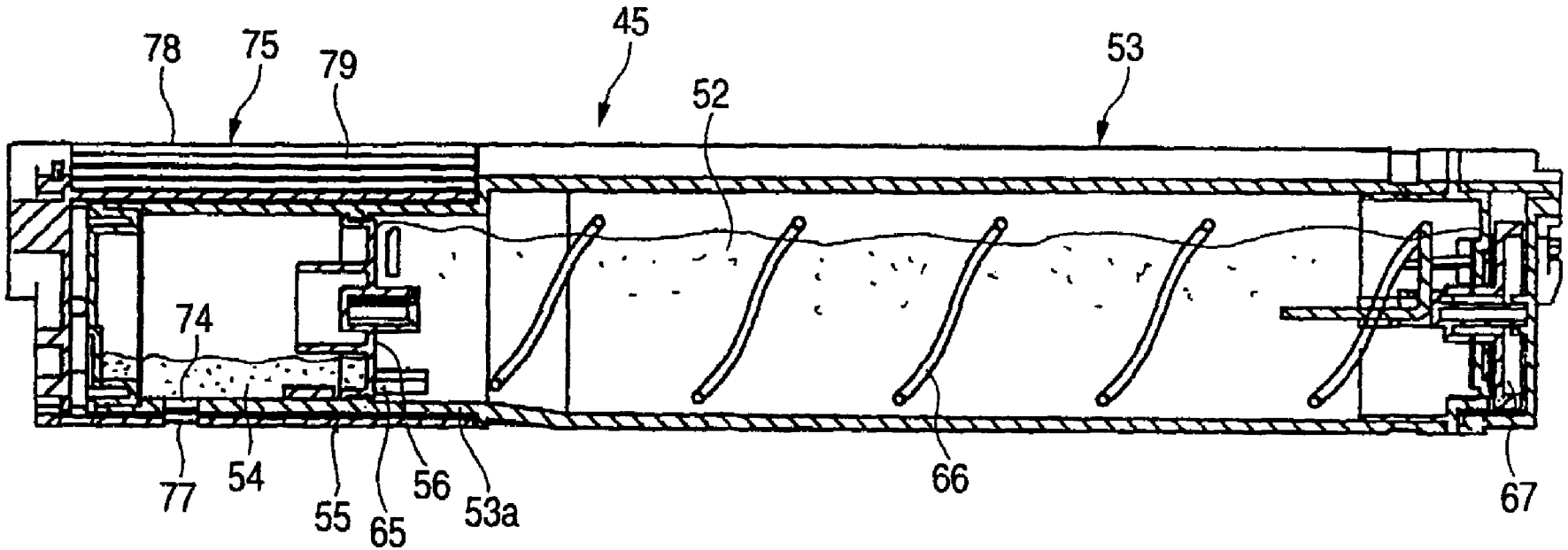
FIG. 10 is a longitudinal cross-sectional view showing the developer cartridge.
Figure 11:
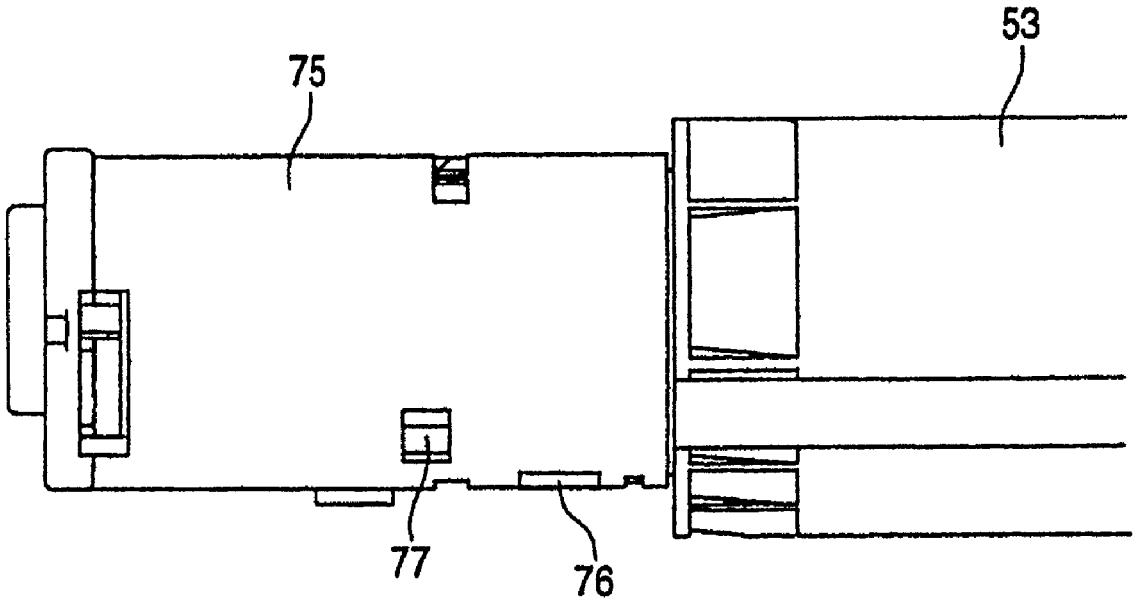
FIG. 11 is a schematic view showing the essence of the developer cartridge.

By the way, the developer receiving portion 53 of the developer cartridge 45 is formed like non-circle, but not circle, in cross section, as shown in FIGS. 8 and 9. The cross-sectional shape of the developer receiving portion 53 is triangular such that the angle of a corner portion 58 at the top is set to be slightly small, each of the corner portions 57, 58 and 59 being formed like a circular arc, or a tear-drop shaped like a falling tear, as shown in FIGS. 9A to 9C. Particularly, the cross-sectional shape of the developer receiving portion 53 is such that a first corner portion 57 located at the lower end is formed like a circular arc having a relatively large radius, and the first and second side faces 60, 61 formed like plane are disposed like a V-character making an angle of about 60 degrees around the first corner portion 57. Also, a second corner portion 58 and a third corner portion 59 located at the top of a first side face 60 and a second side face 61 are formed like circular arc to have a smaller radius than the first corner portion 57, and the almost same radius. And a third side face 62 connecting the second corner portion 58 and the third corner portion 59 is formed like circular arc having as large a radius as that of the flange member 42 on the front side of the developing device 5, as shown in FIG. 4.

Consequently, for the developer receiving portion 53 of the developer cartridge 45, the cross-sectional shape of the developer receiving portion 53 is not circular and shaped like non-circle to occupy almost all the space S2 except for the developing unit 5Y among the space S1 allocated to one developing unit 5Y of the developing device main body 46 on which the developer cartridge 45 is mounted, as shown in FIG. 9C. Therefore, even when the total size of the developing device 6 is reduced, and the diameter of the developing device 6 is set small, the developer receiving portion 53 can receive a large amount of developer 52.

On the other hand, for the developer withdrawal portion 55 linked to one end of the developer receiving portion 53, the cross-sectional shape of the developer withdrawal portion 55 is formed like circle to be substantially inscribed in the space S2 except for the developing unit 5 among the space S1 allocated to one developing unit 6 of the developing device main body 46 on which the developer cartridge 45 is mounted, with the diameter of circle being slightly smaller than that of the space S2, as shown in FIGS. 9A and 9C. This developer withdrawal portion 55 is formed integrally like a cylinder having the shape of circular cross section at one end of the developer receiving portion 53 in the longitudinal direction, and the partition cap 56 is disposed at an end portion close to the developer receiving portion 53 of the developer withdrawal portion 55, as shown in FIG. 10.

More particularly, the developer receiving portion 53 is formed slightly slender at an end portion close to the developer withdrawal portion 55, and linked to the developer withdrawal portion 55 formed like cylinder, as shown in FIG. 10. Consequently, in the developer receiving portion 53, an end portion 53*a* close to the developer withdrawal portion 55 is formed the same cylinder shape as the developer withdrawal portion 55. In the cylindrical portion 53*a* of the developer receiving portion 53, a supply port 65 for supplying the new developer 52 to the outside is opened like rectangle at a slightly inclined position at an end portion of the developer withdrawal portion 55, as shown in FIG. 10. Also, a spiral agitator 66 for agitating the new developer 52 received inside the developer receiving portion 53 is disposed rotatably inside the developer receiving portion 53. The developer 52 is conveyed through the supply port 65 to the outside by this agitator 66. At an end portion on the rear side of the developer cartridge 45, a gear 67 for rotationally driving the agitator 66 is provided such that a part thereof is exposed outside. This gear 67 is mated with a gear 67*a* provided on the developing device main body 46 to rotationally drive the agitator 66 in a state where the developer cartridge 45 is mounted in the developing device main body 46, as shown in FIG. 7.

The developing unit 5Y supplied with the developer 52 from the developer cartridge 45 has a shutter plate 68 on the side of the developing unit in contact with a portion corresponding to the supply port 65 of the developer cartridge 45, in which the shutter plate 68 is curved like circular arc, as shown in FIG. 7. This shutter plate 68 is mounted to be freely slidable along the arrow direction on the developing unit main body 46. Also, the shutter plate 68 has opened a refilling faucet 69 for receiving the new developer 52 supplied from the developer cartridge 45, with a convex piece 69*a* projecting inwards at an end portion around the outer circumference of the refilling faucet 69. The developing unit 5Y refilled with the developer 52 through the refilling faucet 69 extends over a predetermined length in the upper part on the rear side of the developing device main body 46, as shown in FIGS. 6A, 6B and 7. The developer is conveyed over a predetermined distance in the longitudinal direction of the developing unit main body 46 by a refilling auger 71 having a compensating port 71*a* of developer at the entrance, and then refilled into the inside of the developing unit main body 46 through a refilling opening portion, not shown, provided in the upper part on the rear side of the developing unit main body 46.

Moreover, the developing unit 5Y is provided with a withdrawal opening portion 95 in the upper part on the rear side of the developing unit main body 46 to withdraw the used developer among the developer 51 received inside the developing unit main body 46, as shown in FIG. 6B. When the developing unit 5Y is rotated and moved to position C of FIG. 4, a flap 73 is opened to withdraw a part of the used developer 54. The used developer 54 from the developing unit 5 is withdrawn through a withdrawal exhaust port 77 opened in the shutter plate 68, as shown in FIGS. 9A to 9C, and through a withdrawal port 74 opened in the developer cartridge 45, as shown in FIG. 10, into the developer withdrawal portion 55 of the developer cartridge 45, as shown in FIG. 6B. A convex piece 70*a* is also protruded inwards in the withdrawal exhaust port 70 of the developing unit, as shown in FIG. 7.

Also, in this embodiment, a shutter member 75 as an opening/closing member for opening or closing the supply port 65 of the developer receiving portion 53 and the withdrawal port 74 (example of recovery port) of the developer withdrawal portion 55 (example of developer recovery portion) is inserted and fitted rotatably in the circumferential direction around the outer circumference of the developer receiving portion 53*a* (example of developer containing portion) and the developer withdrawal portion 55 that are formed like cylinder in the developer cartridge 45, as shown in FIGS. 8 and 9. This shutter member 75 is formed like cylinder, like the developer receiving portion 53*a* and the developer withdrawal portion 55 of the developer cartridge 45, as shown in FIGS. 8 and 9. The shutter member 75 has an inner diameter slightly larger than the outer diameter of the developer withdrawal portion 55, and is formed like circle to be substantially inscribed in the space S2 except for the developing unit 5Y among the space S1 allocated to one developing unit 5Y of the developing device main body 46 on which the developer cartridge 45 is mounted, as shown in FIG. 8 and 9C.

The shutter member 75 has opened a supply opening portion 76 and a withdrawal opening portion 77 at the positions corresponding to the supply port 65 and the withdrawal port 74 of the developer cartridge 45, as shown in FIGS. 6A, 6B, 10 and 11. This shutter member 75 can be rotated along the outer circumference of the developer withdrawal portion 55 of the developer cartridge 45 to open or close the supply port 65 and the withdrawal port 74 of the developer cartridge 45 at the same time. The convex pieces 76*a* and 77*a* are protruded outwards at the edge of the supply opening portion 76 and the withdrawal opening portion 77 of the shutter member 75.

Also, the shutter member 75 has a grip 78 for gripping the developer cartridge 45 to mount it on the developing device main body 46, as well as rotating the shutter member 75 in a part along the circumferential direction of the developer cartridge, in which the grip 78 is protruded radially outwards, as shown in FIG. 8. For this grip 78, the radius of curvature at the top end is set up to be coincident with the second corner portion 58 of the developer receiving portion 53 for the developer cartridge 45 in a state where the developer cartridge 45 is mounted on the developing unit main body 46 and the shutter member 75 is opened, as shown in FIG. 9A. A non-slip portion 79 containing a plurality of convex pieces to facilitate the gripping is provided on the side face of the grip 78.

Moreover, the grip 78 of the shutter member 75 extends out of the outer circumference of the developing device main body 46 in a state where the supply port 65 and the withdrawal port 74 of the developer cartridge 45 are closed by rotating the shutter member 75 in the clockwise direction, as shown in FIG. 9A.

By the way, in this embodiment, an image forming apparatus comprises a rotary developing device in which a developing device main body is disposed rotatably within a vertical plane and a plurality of developing units and a plurality of developer cartridges for supplying developer to the developing units are arranged along a circumferential direction of the developing device main body, a frame for supporting the rotary developing device in free rotation, and a drive source for rotationally driving the rotary developing device, characterized in that the drive source for rotationally driving the rotary developing device is disposed in an area to which the rotary developing device is projected in a direction orthogonal to a rotation axis.

Also, in this embodiment, a driving force of the drive source is transmitted to a driving gear with external teeth disposed around the outer circumference at one end portion of the rotary developing device.

Moreover, in this embodiment, the drive source is mounted on the same plane of the frame as the rotary developing device.

Also, in this embodiment, the drive source and the rotary developing device are mutually connected via a reduction gear.

Moreover, in this embodiment, an image forming apparatus comprises an image carrier disposed rotatably, a rotary developing device for developing sequentially an electrostatic latent image formed on the image carrier with a toner of different color, in which a developing device main body is rotatably disposed within a vertical plane and a plurality of developing units and a plurality of developer cartridges for supplying developer to the developing units are arranged along a circumferential direction of the developing device main body, an intermediate transfer body on which a primary transfer of a toner image of different color developed sequentially on the image carrier is performed multiply, and secondary transfer means for performing a secondary transfer of the toner image of different color transferred onto the intermediate transfer body multiply onto a recording sheet, characterized in that the intermediate transfer body is overlapped on top of the rotary developing device, a primary transfer position and a secondary transfer position of the intermediate transfer body are closely placed, and the drive source for rotationally driving the rotary developing device is disposed at a position opposed at about 180° to the image carrier around the outer circumference of the rotary developing device in an area to which the rotary developing device is projected in a direction orthogonal to a rotation axis.

Also, in this embodiment, a control board and a power source unit of the image forming apparatus are disposed in the area to which the rotary developing device is projected in the direction orthogonal to the rotation axis.

Figure 1:
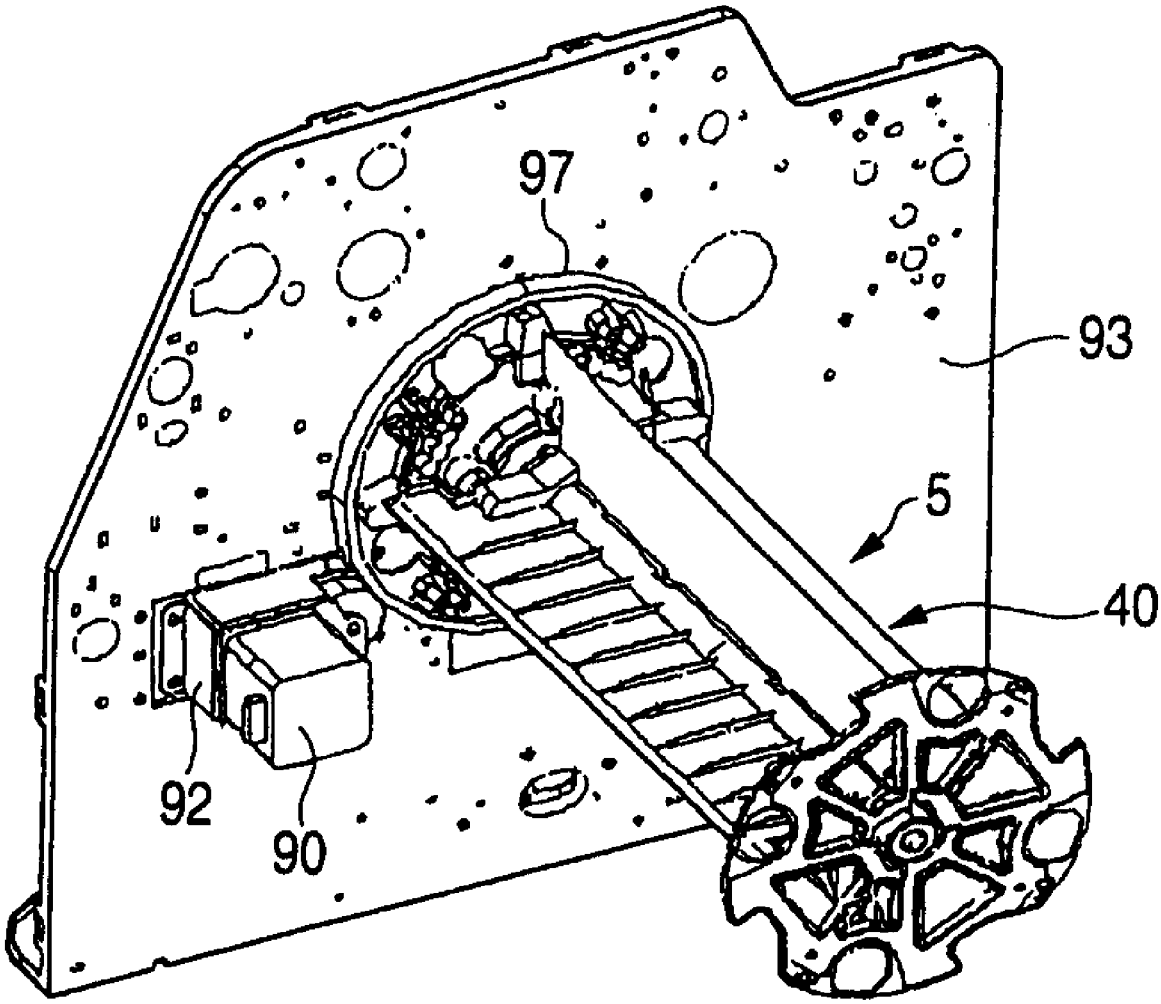
FIG. 1 is a perspective view showing the essence of a full-color printer as an image forming apparatus according to a first embodiment of this invention.
Figure 12:
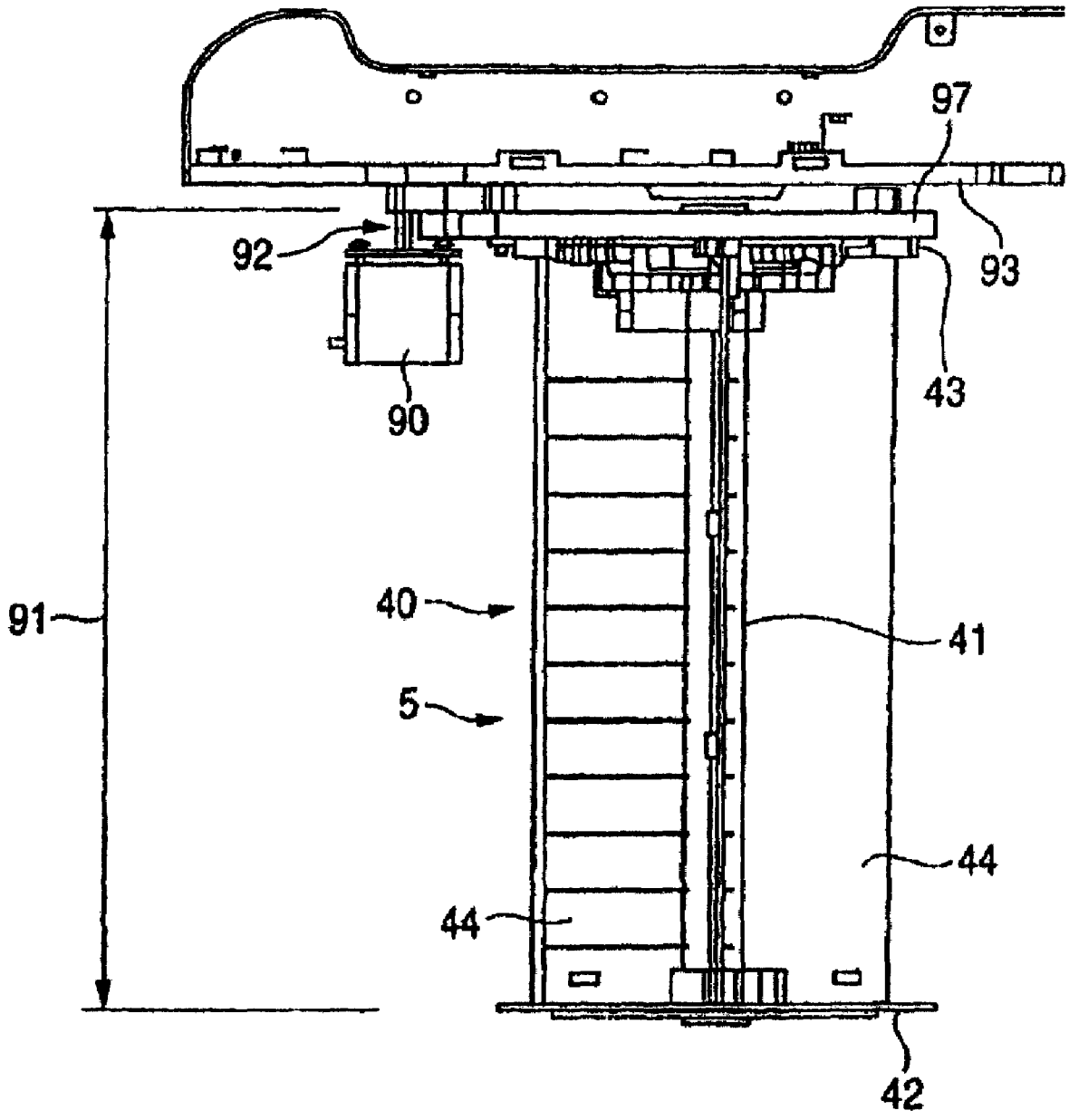
FIG. 12 is a plan view showing the essence of the full-color printer as the image forming apparatus according to the first embodiment of this invention.
Figure 13A:
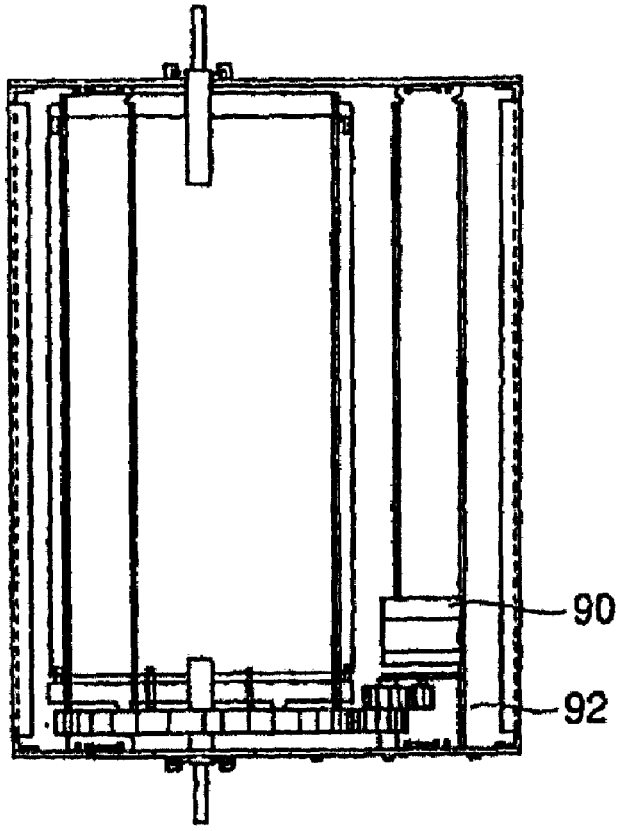
FIGS. 13A to 13C are schematic views showing a driving system of the rotary developing device.
Figure 13B:
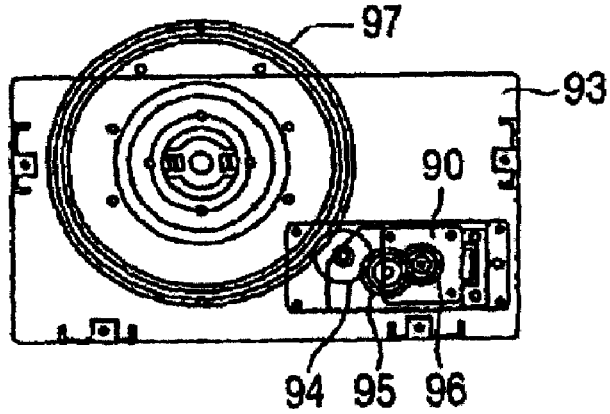
Figure 13C:
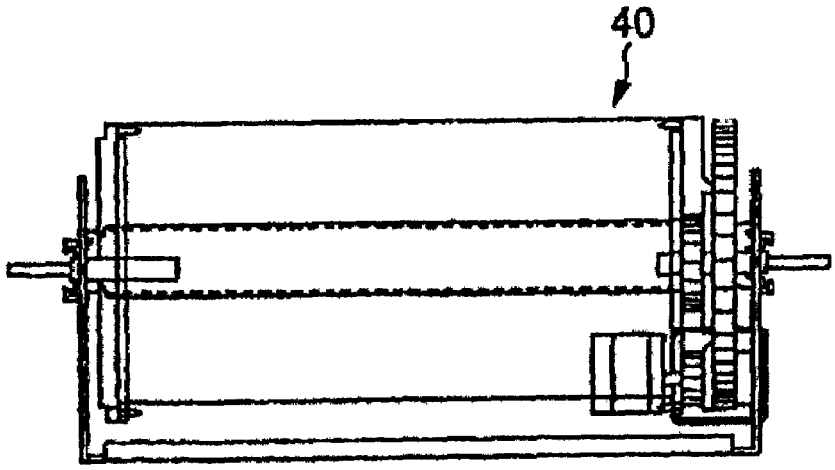
Figure 14:
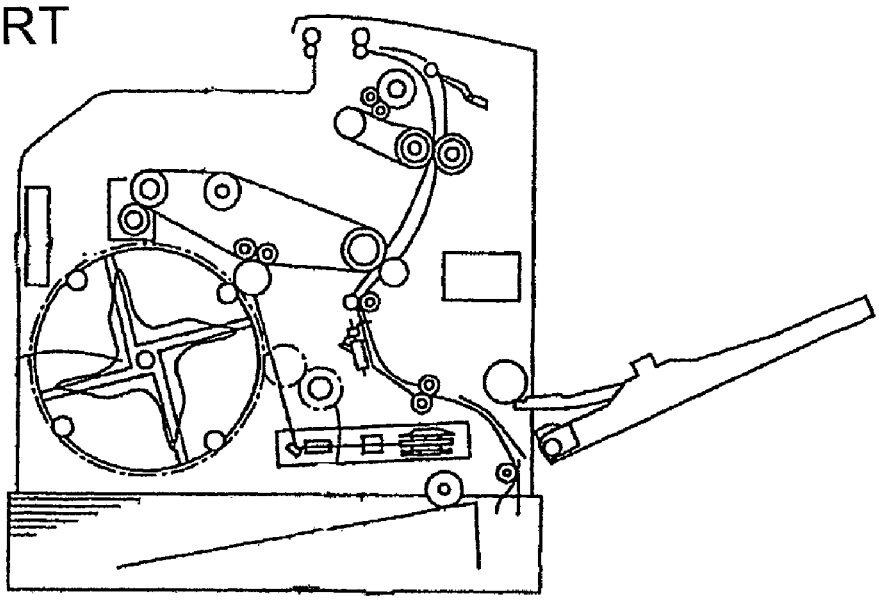
FIG. 14 RELATED ART
FIG. 14 is a schematic view showing the conventional image forming apparatus.
Figure 15:
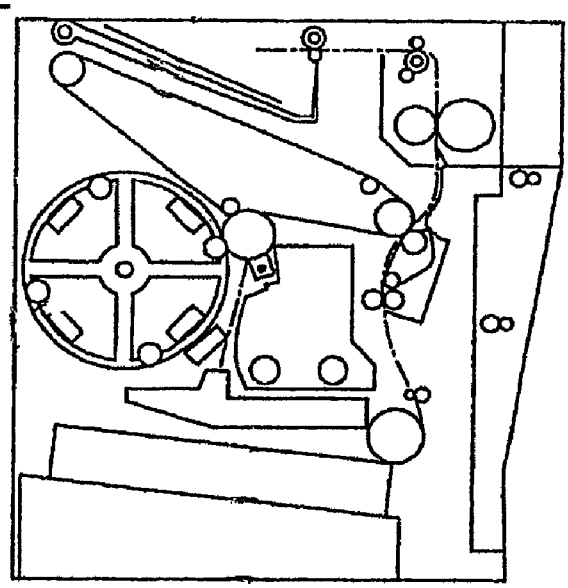
FIG. 15 RELATED ART
FIG. 15 is a schematic view showing the conventional image forming apparatus.

That is, in this embodiment, a drive motor 90 including a pulse motor as a drive source for rotationally driving the rotary developing device 5 is disposed in an area 91 to which the rotary developing device 5 is projected in the direction orthogonal to a rotation axis member 41 as a rotation axis, as shown in FIGS. 1 and 12. This drive motor 90 is mounted via a reduction gear box 92 on the same plane of a frame 93 as the rotary developing device 5 in the printer main body 1. The reduction gears 94 and 95 are contained within the reduction gear box 92 in a state where they are mated with a driving gear 96 of the drive motor 90. Also, the reduction gear 94 is mated with a developing device gear 97 with external teeth having a larger diameter attached at an end portion of the developing device main body 40 in the rotary developing device 5, as shown in FIG. 13. The reduction ratio of the developing device main body 40 to the rotating number of the drive motor 90 is set to 1/20, for example.

Though the rotary developing device 5 is reduced in size, the developing device main body 40 has four developing units 5Y, 5M, 5C and 5K of yellow (Y), magenta (M), cyan (C) and black (K), and four developer cartridges 45Y, 45M, 45C and 45K of yellow (Y), magenta (M), cyan (C) and black (K), which are packaged along the circumferential direction, as shown in FIG. 4. The diameter of the developing device main body 40 is the largest in the printer, and the mass and the rotational moment are large. Also, in the rotary developing device 5, it is required to switch the developing units 5Y, 5M, 5C and 5K of yellow (Y), magenta (M), cyan (C) and black (K) within a limited period of time to increase the productivity of the printer. Consequently, the drive motor 90 is made as small as possible, but the largest as the motor within the printer.

In this case, the drive motor 90 rotationally drives the rotary developing device 5 at a reduction ratio as large as 1/20, and can be made as small as possible.

Moreover, in this embodiment, the intermediate transfer belt 6 is overlapped on top of the rotary developing device 5, and a primary transfer position and a secondary transfer position of the intermediate transfer belt 6 are closely placed, as shown in FIG. 2. Also, the drive motor 90 is disposed at a position opposed at about 180° to the photoconductive drum 2 around the outer circumference of the rotary developing device 5 in an area 91 to which the rotary developing device 5 is projected in a direction orthogonal to a rotation axis.

Also, in this embodiment, a power source circuit 95 for supplying power to the drive motor 90 for rotationally driving and a control board 96 for controlling the printer are attached on the same plane as the drive motor 90 for the frame 93 with the drive motor 90 mounted.

With the above constitution, the full-color printer as the image forming apparatus according to this embodiment can be reduced in size and thickness in the following way.

That is, in the full-color printer, as shown in FIG. 2, in printing the full-color image, the rotary developing device 5 is switched sequentially to move the developing unit 5Y, 5M, 5C and 5K of desired color to the developing position opposed to the photoconductive drum 2 and develop the electrostatic latent image formed on the surface of the photoconductive drum 2 with the toner of predetermined color.

In this case, the rotary developing device 5 is rotationally driven by the drive motor 90 placed on the same side of the frame 93 as the rotary developing device 5 in switching each developing unit 5Y, 5M, 5C and 5K, as shown in FIG. 1.

In this way, in this embodiment, since the drive motor 90 for the rotary developing device 5 that is relatively large is disposed in a projected area 91 of the rotary developing device 5, the drive motor 90 is restrained from extending to the back side as compared with where the drive motor 90 is disposed on the opposite face of the frame 93 to the rotary developing device 5 as shown in FIGS. 1 and 12, whereby the printer main body 1 can be made as thin as possible.

Also, in this embodiment, since the drive motor 90 for the rotary developing device 5 that is relatively large is disposed in a projected area 91 of the rotary developing device 5, there is a large space for disposing the reduction gears, whereby the torque capacity of the drive motor 90 can be smaller by setting the reduction ratio at a large value, and the drive motor 90 itself is reduced in size.

Moreover, in this embodiment, since the drive motor 90 is fixed to the frame 93 for supporting the rotary developing device 5, the relative positional relationship between the drive motor 90 and the rotary developing device 5 is fixed by the frame 93, thereby stabilizing the driving.

Also, in this embodiment, since the torque capacity of the drive motor 90 is smaller, the drive motor 90 itself is reduced in size.

Moreover, in this embodiment, since the drive motor 90 is disposed sideways of the rotary developing device 5, it is possible to make effective use of the space around the rotary developing device 5, thereby reducing the size of the printer main body 1.

Also, in this embodiment, the power source circuit 95 and the control board 96 are disposed sideways of the rotary developing device 5, it is possible to make effective use of the space around the rotary developing device 5, thereby reducing the size of the printer main body 1.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developer cartridge for supplying a toner-containing developer and for removable mounting on one of a plurality of developing units that are disposed along a rotating outer peripheral surface of a developing unit main body, the developer cartridge comprising:

a developer containing portion that contains the developer supplied to a developing unit;

a developer recovery portion, disposed at one end of the developer containing portion in a longitudinal direction, that recovers a used developer from the developing unit;

a supply port that opens to supply the developer from the developer containing portion to the developing unit;

a recovery port that opens in the developer recovery portion to recover the used and recovered developer from the developing unit; and an opening and closing member, fitted around the outer circumferential of the developer containing portion and the developer recovery portion, that opens or closes the supply port and the recovery port, wherein the developer containing portion is formed slender at an end portion close to the developer recovery portion and linked to the developer recovery portion.

2. The developing cartridge according to claim 1, wherein the end portion of the developer containing portion to close the developer recovery portion is formed the same cylinder shape as the developer recovery portion.

3. The developing cartridge according to claim 1, wherein the developer recovery portion is formed integrally cylinder having the shape of circular cross section at one end of the developer containing portion in the longitudinal direction.

4. The developing cartridge according to claim 1, wherein the opening and closing member is formed cylinder and has an inner diameter slightly larger than the outer diameter of the developer recovery portion.

5. The developing cartridge according to claim 1, wherein the opening and closing member has a supply opening portion and a recovery opening portion at positions corresponding to the supply port and the recovery port, respectively, and the opening and closing member is rotated along the outer circumference of the developer recovery portion to open or close the supply port and the recovery port at the same time.

* * * * *